US007748154B2

(12) United States Patent
Moretti

(10) Patent No.: US 7,748,154 B2
(45) Date of Patent: Jul. 6, 2010

(54) QUICK COUPLING PARTICULARLY FOR THE STOCK OF A PORTABLE WEAPON

(75) Inventor: Luigi Moretti, Brescia (IT)

(73) Assignee: Benelli Armi, S.p.A., Urbino, Pesaro Urbino (IT)

( * ) Notice: Subject to any disclaimer, the term of this patent is extended or adjusted under 35 U.S.C. 154(b) by 20 days.

(21) Appl. No.: 12/217,764

(22) Filed: Jul. 8, 2008

(65) Prior Publication Data

US 2009/0019757 A1 Jan. 22, 2009

(30) Foreign Application Priority Data

Jul. 20, 2007 (IT) ..... MI2007A001472

(51) Int. Cl.
*F41A 21/00* (2006.01)

(52) U.S. Cl. ..... 42/75.03; 42/75.01; 42/75.02; 42/75.04; 42/75.1

(58) Field of Classification Search ..... 42/75.01–75.1
See application file for complete search history.

(56) References Cited

U.S. PATENT DOCUMENTS 1,755,034 A * 4/1930 Louis Stange ..... 42/75.03
3,323,246 A * 6/1967 Theodor Loffler ..... 42/75.01
3,380,182 A * 4/1968 Browning Bruce W .... 42/75.03
4,893,426 A * 1/1990 Bixler ..... 42/75.01
6,671,990 B1 * 1/2004 Booth ..... 42/75.01
2003/0221352 A1 * 12/2003 Steele ..... 42/73
2004/0031182 A1 * 2/2004 Bentley ..... 42/74
2007/0089347 A1 * 4/2007 Webber et al. ..... 42/75.03
2007/0289190 A1 * 12/2007 Oz ..... 42/73
2009/0019755 A1 * 1/2009 Moretti ..... 42/75.01

* cited by examiner

*Primary Examiner*—Troy Chambers
*Assistant Examiner*—Samir Abdosh
(74) *Attorney, Agent, or Firm*—R. Neil Sudol; Coleman Sudol Sapone, P.C.

(57) ABSTRACT

A quick coupling for the stock of a portable weapon, automatically provides the stock with a specific drop and cast upon its coupling by means of an interchangeable plate which can be replaced easily. The characteristics and the number of plates available are such as to meet the variation requirements made by the various users. The new quick coupling has considerable advantages in terms of constructive technical simplicity, ease of drop and cast adjustment, quick disassembly and maintenance of the weapon.

19 Claims, 6 Drawing Sheets

QUICK COUPLING PARTICULARLY FOR THE STOCK OF A PORTABLE WEAPON

BACKGROUND OF THE INVENTION

1. Field of the Invention

The present invention relates to a quick coupling particularly for the stock of a portable weapon.

2. Description of the Prior Art

Systems for coupling the stock to the barrel extension or to the receiver of portable weapons have long been known in which it is possible also to vary their trim by means of plates which are generally assembled together with the stock and subsequently fixed to the weapon by screws or nuts.

The plate or plates that determine the drop and cast are generally interposed between the stock and the member of the weapon onto which the stock is to be fitted, while the fixing plate is generally fitted on a tube or tension member which constitutes the extension of the weapon inside the stock and is fixed thereon by a screw or a nut.

These mechanisms are generally rather complicated and expensive, require special tools and skill in the use of the weapon in order to perform its disassembly, both when it is necessary to vary the drop and cast given initially and in case of maintenance and cleaning.

In order to be able to perform the replacement it is in fact necessary to disassemble several components of the weapon which do not strictly belong to the coupling system, such as: the butt plate, the butt plate fastening screws, and any members inside the stock which are used as a support for the locking plate.

SUMMARY OF THE INVENTION

The aim of the present invention is to provide a quick coupling which overcomes the drawbacks of the cited prior art.

Within the scope of this aim, an object of the present invention is to provide a quick coupling for the stock of a portable weapon which can be disassembled without requiring particular tools and automatically provides the selected drop and cast of the stock upon its coupling to the weapon.

Another object of the invention is to allow to vary the trim of the stock simply by replacing a single component without having to disassemble other components of the weapon or stock which do not strictly belong to the quick coupling system.

This aim and these and other objects which will become better apparent hereinafter are achieved by a quick coupling particularly for the stock of a portable weapon, comprising an elastically deformable body fitted to the stock of a portable weapon and provided with a means for engaging a component of said portable weapon, said elastically deformable body having a position which is not elastically deformed and a position which is elastically deformed, said elastically deformable body engaging said component of said portable weapon in said elastically deformed position.

According to a preferred embodiment of the invention, the quick coupling for stocks of portable weapons comprises a main annular body which has externally threaded sectors and a cylindrical stem for centering on the stock which is internally hollow in order to accommodate conical annular disk springs (Belleville springs) fitted thereon by means of a nut which is provided with an extended external shank which passes internally through the Belleville springs and through the main body in order to allow assembly by means of a snap ring which is fitted to the portion of the outer shank of the nut that protrudes from the main body.

The Belleville springs, when the assembly is assembled, are still not preloaded, both to allow their easy assembly and to facilitate the screwing of the nut onto the corresponding threaded pin or tension member fitted on the stock.

The quick coupling for stocks of portable weapons according to the present invention also comprises a threaded pin which is fitted directly onto the stock where the cylindrical portion of the main body, which constitutes the engagement member of the quick coupling, is accommodated.

In order to ensure that the cylindrical portion of the main body is properly registered on the stock, it is centered on a plate which is contoured and locked to the stock by a screw and a nut so as to provide a compact and rigid structure which might also be manufactured by overmolding of the contoured plate on the stock, if the stock is made of technopolymer.

Plates of different shapes may be fit, between the main body of the quick coupling and the front plane of the stock that rests on the weapon. The plates are accordingly interchangeable and ensure the drop and cast of the stock by way of the strong compression of the Belleville springs which can be obtained when the entire quick coupling is screwed against the front plane of the stock.

The Belleville springs are further compressed when the entire stock, complete with the quick coupling, engages by rotation on the portion of the weapon where its coupling seat is provided, so as to eliminate any small free movement of the stock caused by to the coupling tolerances of the various components.

The front plane of the weapon, which surrounds the coupling seat of the quick coupling, provided on the barrel extension or on the receiver, adheres to the interchangeable plate, which is provided in order to determine the drop and cast of the stock, transferring its drop and cast characteristics to the stock without locking the stock rigidly to the weapon.

Accordingly, upon firing, the kinetic energy of the recoil of the weapon further compresses the Belleville springs of the quick coupling without however affecting the drop and cast of the stock but further dissipating partly before being released against the shoulder of the shooter.

The quick coupling for stocks of portable weapons according to the present invention is provided with references signs, such as pins or slots, to ensure that the entire quick coupling is fitted on the stock with the correct orientation with respect to the interface of the weapon on which it engages so as to achieve, when the coupling rotation is completed, the correct fitting of the entire stock to the weapon.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DESCRIPTION OF THE PREFERRED EMBODIMENTS OF THE INVENTION

Figure 1:
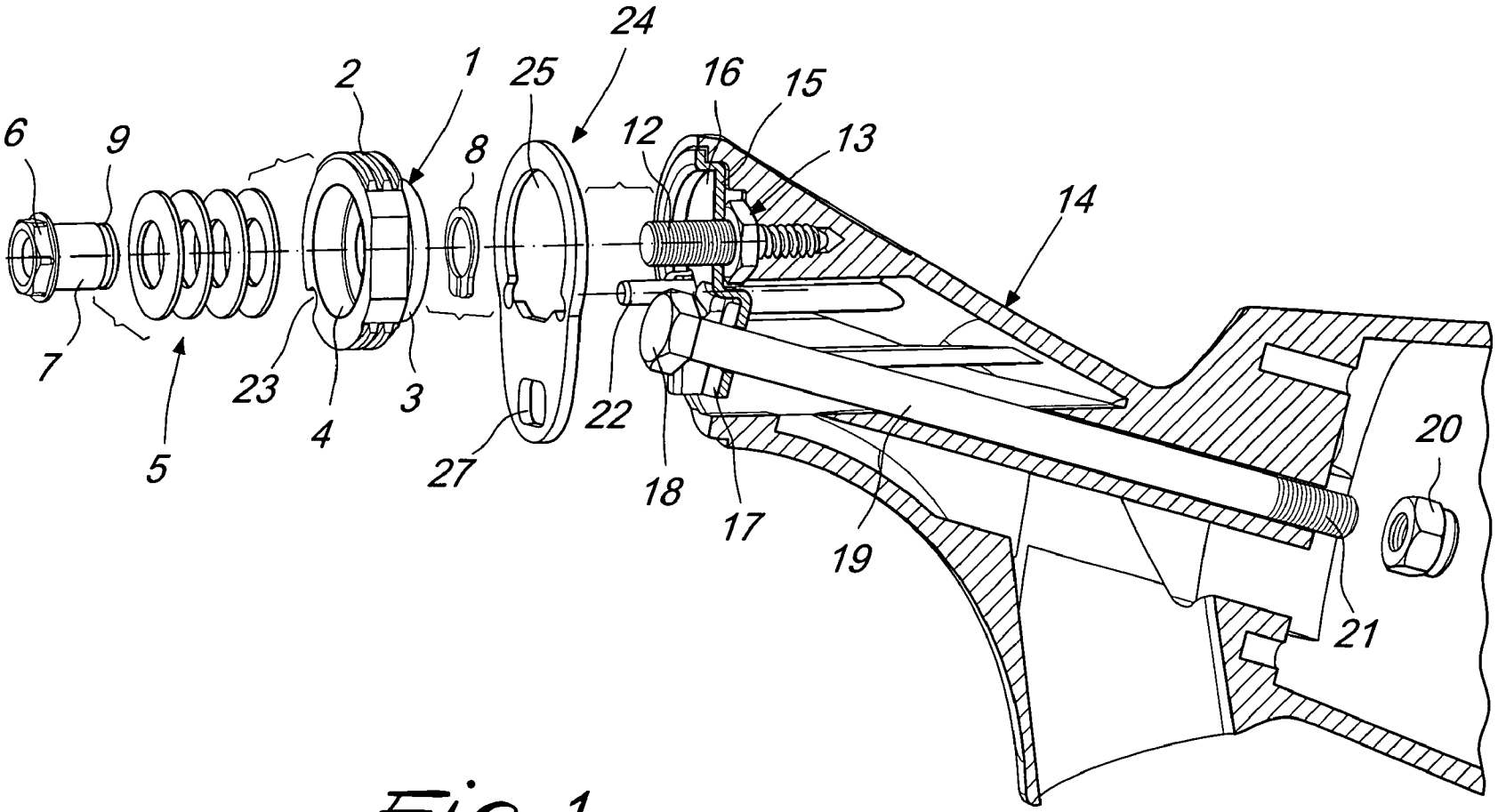
FIG. 1 is an exploded perspective view of the quick coupling for the stock of a portable weapon according to the present invention.

With reference to the cited figures, the quick coupling according to the invention comprises an annular main body 1 provided with threaded sectors 2, a cylindrical shank 3 for centering on the stock, and an internal seat 4 for Belleville springs 5, which are conical annular disks or washers.

A fastening nut 6 is provided with a shank 7 which passes internally through the Belleville springs 5 and through the main annular body 1 to ensure the assembly of the Belleville springs 5 on the main annular body 1 by means of a snap ring 8 which engages on a seat 9 thereof, which is provided at the rear end of the shank 7 of the fixing nut 6.

Figure 2:
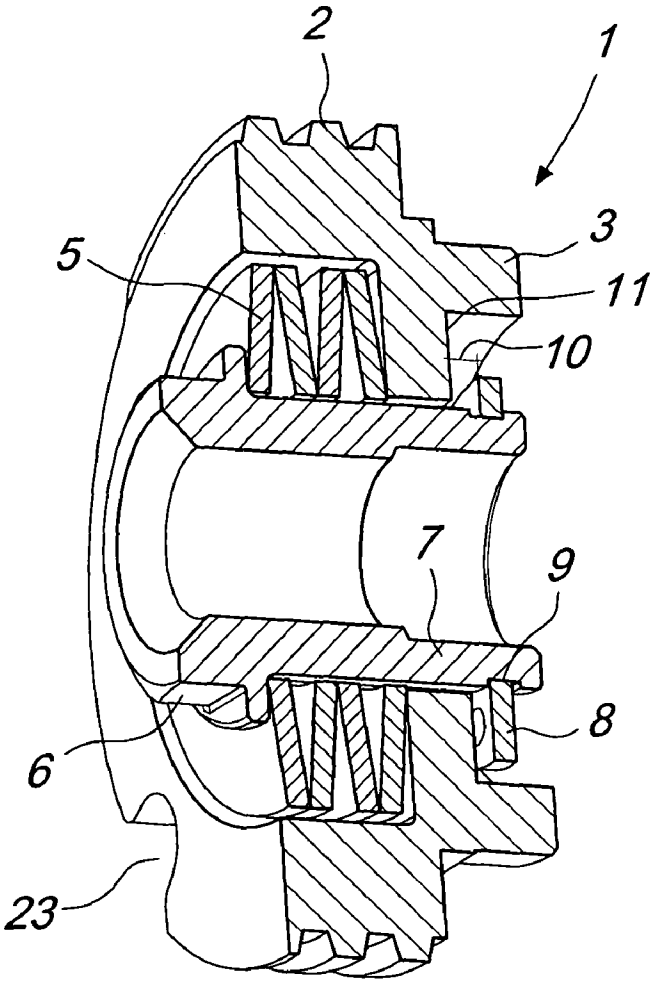
FIG. 2 is an enlarged perspective sectional view of the main annular body, shown in the assembled condition.

As better seen in FIG. 2, the main annular body 1 does not have assembly difficulties, because the entire assembled set still keeps the Belleville springs 5 and the nut 6 free to move by way of an axial play 10, which is ensured between a shoulder plane 11 of the main body 1 and the snap ring 8.

With particular reference to FIG. 1, the entire annular main body 1 in the assembled condition can therefore be screwed freely, at least in the initial step, on a threaded shank 12 of the tension member 13 which is fitted on the stock 14.

Preferably, there is also a centering plate 15, which is shaped in order to obtain both a circular centering seat 16 for the cylindrical shank 3 of the main body 1 and a seat 17 for the head 18 of the screw 19, which rigidly couples the centering plate 15 to the stock 14 when it is locked by screwing forcefully the self-locking nut 20 to the threaded end 21 of the screw 19.

The threaded sectors 2 of the main body 1, which is assembled as shown in FIG. 2, are oriented correctly on the stock 14 by an orientation pin 22, which is fitted on the stock 14 by virtue of a groove 23 formed on the main body 1.

The groove 23 perfectly combines with the orientation pin 22 in order to allow the mating of the cylindrical centering shank 3 of the main body 1 with the internal seat 16 of the centering plate 15, so as to define a single possible assembly position.

The quick coupling, according to the present invention, offers the possibility to provide the stock 14 with a specific drop and cast, with respect to the aiming line of the weapon, by way of an adjustment member constituted by an abutment plate 24.

Figure 3:
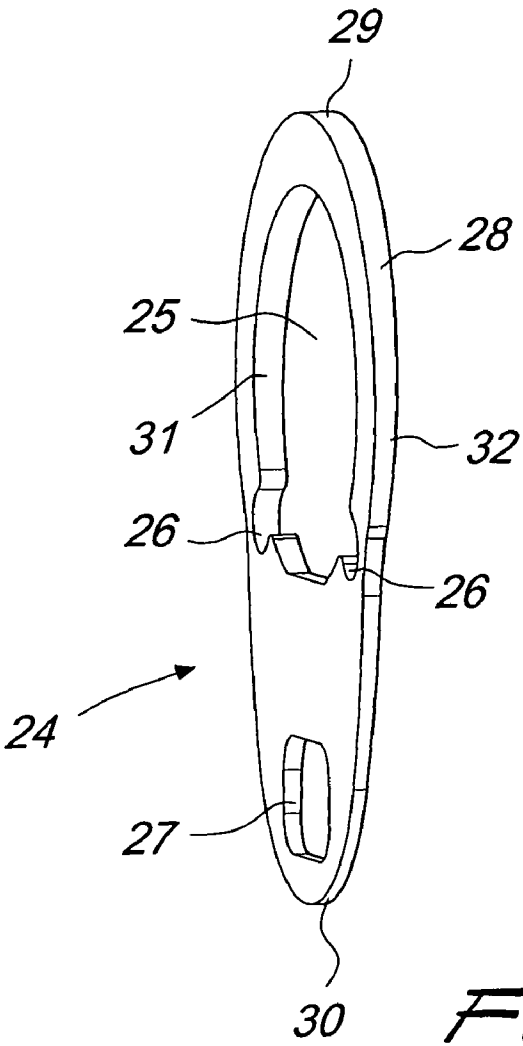
FIG. 3 is an enlarged perspective view of a plate for changing the drop and cast of the stock.

The abutment plate 24, shown in FIG. 3, is provided with a central hole 25, with two grooves 26, and with a slot 27.

The thickness 28 of the plate 24 is conveniently determined in relation to the drop and cast that the stock 14 must have with respect to the aiming line of the weapon.

The thickness 28 of the plate 24 is therefore different, both when considered on its vertical axis and when considered on its horizontal axis, both of which pass through the central hole 25, as can be seen clearly by observing respectively the points 29 and 30, considered for the vertical axis of the plate 24, and the points 31 and 32, considered for the horizontal axis of the plate.

In other words, one can say that the inclination determined by the difference in thickness which can be observed between the points 29 and 30 of the plate 24 corresponds to one of the drop values of the stock 14 normally used also in currently known systems.

By providing multiple plates 24, which have mutually different inclination values determined by the thickness variation of the points 29 and 30 of the plates, it is possible to obtain various different values of the drop of the stock 14 which are capable of meeting the usual requirements of the various users.

Likewise, the inclination determined by the thickness variation that can be observed between the points 31 and 32 of the plate 24 corresponds to a given lateral cast value of the stock 14 with respect to the barrel axis of the weapon.

This value is usually constant, regardless of the various drop values that the stock 14 can assume, and therefore all the plates optionally provided with the weapon have the same thickness variation observable between the respective points 31 and 32.

Each plate 24, is provided with two grooves 26 and can be registered on the orientation pin 22 in two different positions, the one shown in FIG. 1 and the one that can be obtained by flipping the plate over, through 180°, about its vertical axis, so as to have, in the first case, a given right cast of the stock 14 with respect to the aiming line of the weapon and, in the second case, a similar left cast of the stock 14.

Figure 4:
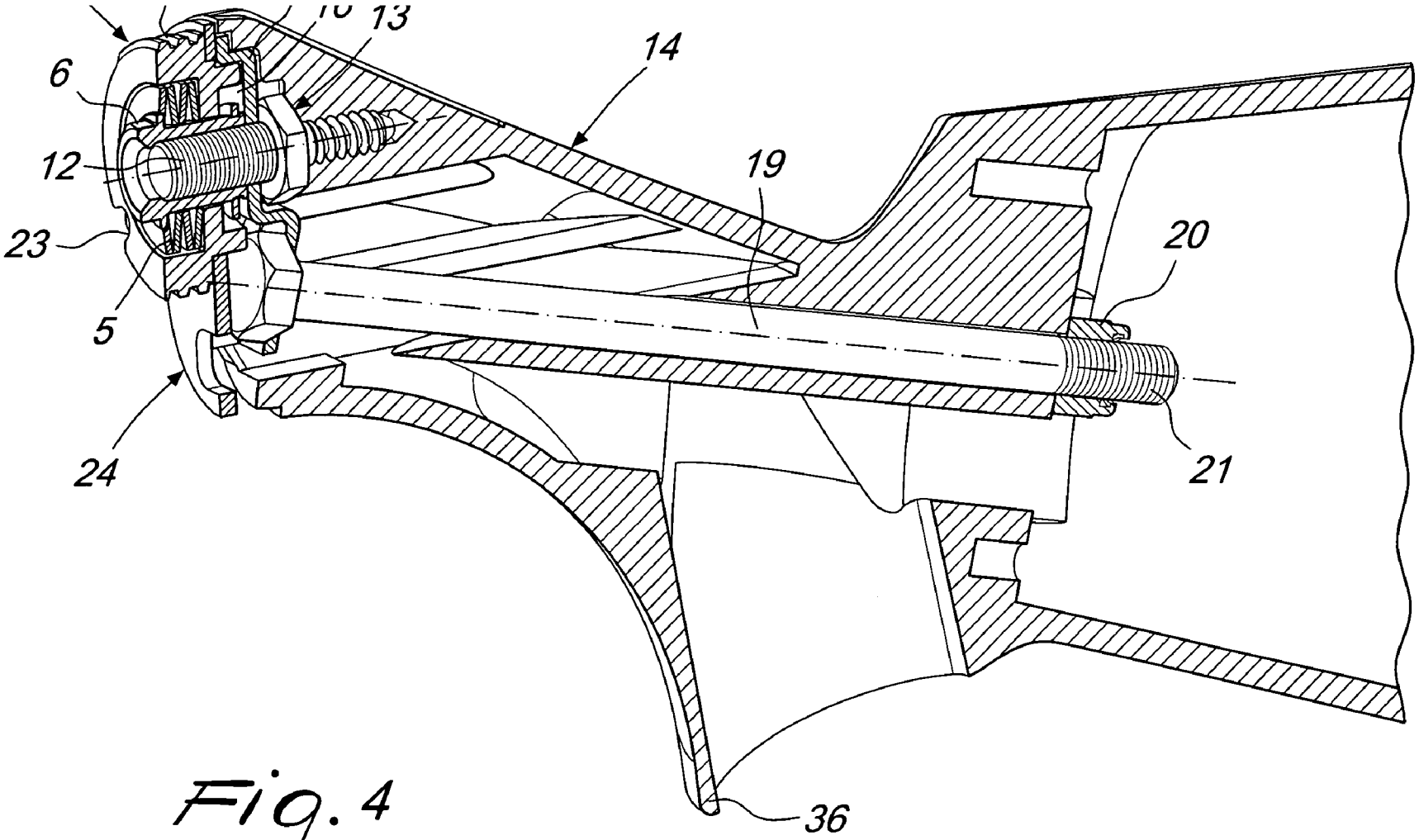
FIG. 4 is a sectional perspective view of the quick coupling according to the present invention, shown in the condition in which it is fitted to the stock of the weapon in the quick coupling position that corresponds to the position assumed when it is coupled on its seat provided on the sheath or barrel extension with the stock correctly fitted on the weapon.

The drop and cast of the stock 14 provided by the plate 24 are determined when the entire quick coupling for stocks of portable weapons according to the present invention is assembled as shown in FIG. 4. FIG. 4 shows the complete system with the tension member 13 screwed onto the stock 14, the centering plate 15, accommodated and locked on the stock 14 by the screw 19, and the self-locking nut 20, the plate 24 interposed between the stock 14 and the main annular body 1. Annular body 1 is assembled as shown in FIG. 2 and is oriented by means of the groove 23 on the orientation pin 22. Annular body 1 is screwed completely, by way of the nut 6, onto the threaded stem 12 of the tension member 13, determining such a compression of the Belleville springs 5 as to ensure perfect adhesion between the stock 14, the plate 24 and the main annular body 1.

It is thus evident that, by unscrewing the nut 6, it is possible to disassemble the main annular body 1, which is assembled as in FIG. 2, replace or flip over the plate 24 and screw in again the nut 6 in order to obtain a different drop or cast of the stock.

The stock, complete with the quick coupling according to the present invention, according to this embodiment, is fitted onto the weapon on the barrel extension 33 of the weapon.

Figure 5:
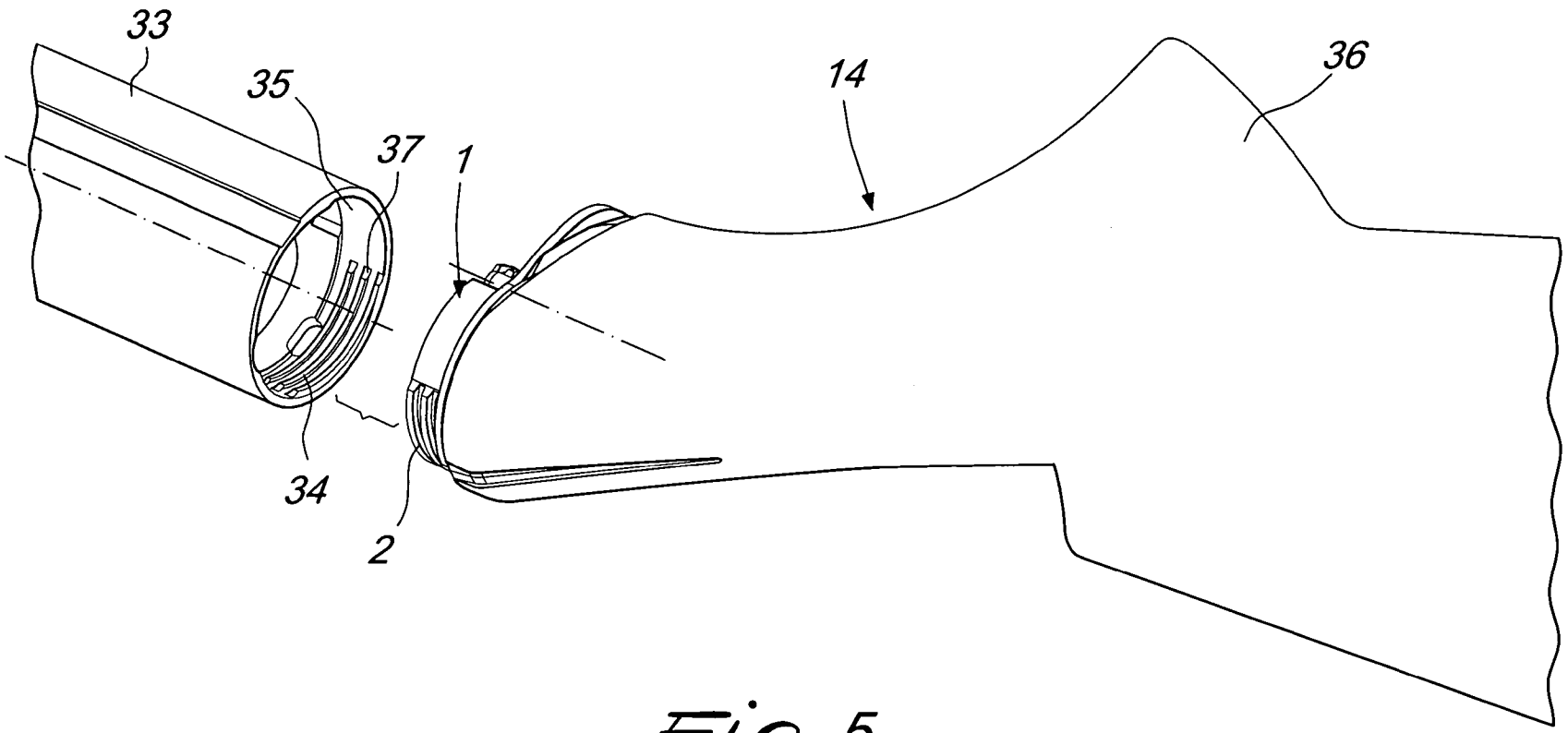
FIG. 5 is a perspective view of the quick coupling according to the present invention, as fitted to the stock of the weapon in a position for the entry of the quick coupling on its seat provided on the sheath or barrel extension of the weapon.

As shown schematically in FIG. 5, in order to assemble the stock 14, complete with the quick coupling, it is sufficient to arrange the stock 14 adjacent to the sheath or barrel extension 33, which has, at the rear and internally, threaded sectors 34 which are suitable to screw onto the similar threaded sectors 2 provided on the main annular body 1.

Screwing occurs rapidly, by inserting the entire main annular body 1 in the barrel extension 33, taking care, during insertion, to align its threaded sectors 2 with the recesses 35, which are also provided inside the barrel extension 33, the alignment being easily obtainable by keeping the pistol grip of the stock 36 in a transverse position with respect to the vertical axis of the weapon, i.e., at 90°, and then screwing together the threaded sectors 2 of the main annular body 1 and the respective threaded sectors 34 of the sheath or barrel extension 33, with a rotary motion of the stock which has an end rotation position determined automatically by contact of the orientation pin 22 against the end portion 37 of the recess 35 cited above.

Figure 6:
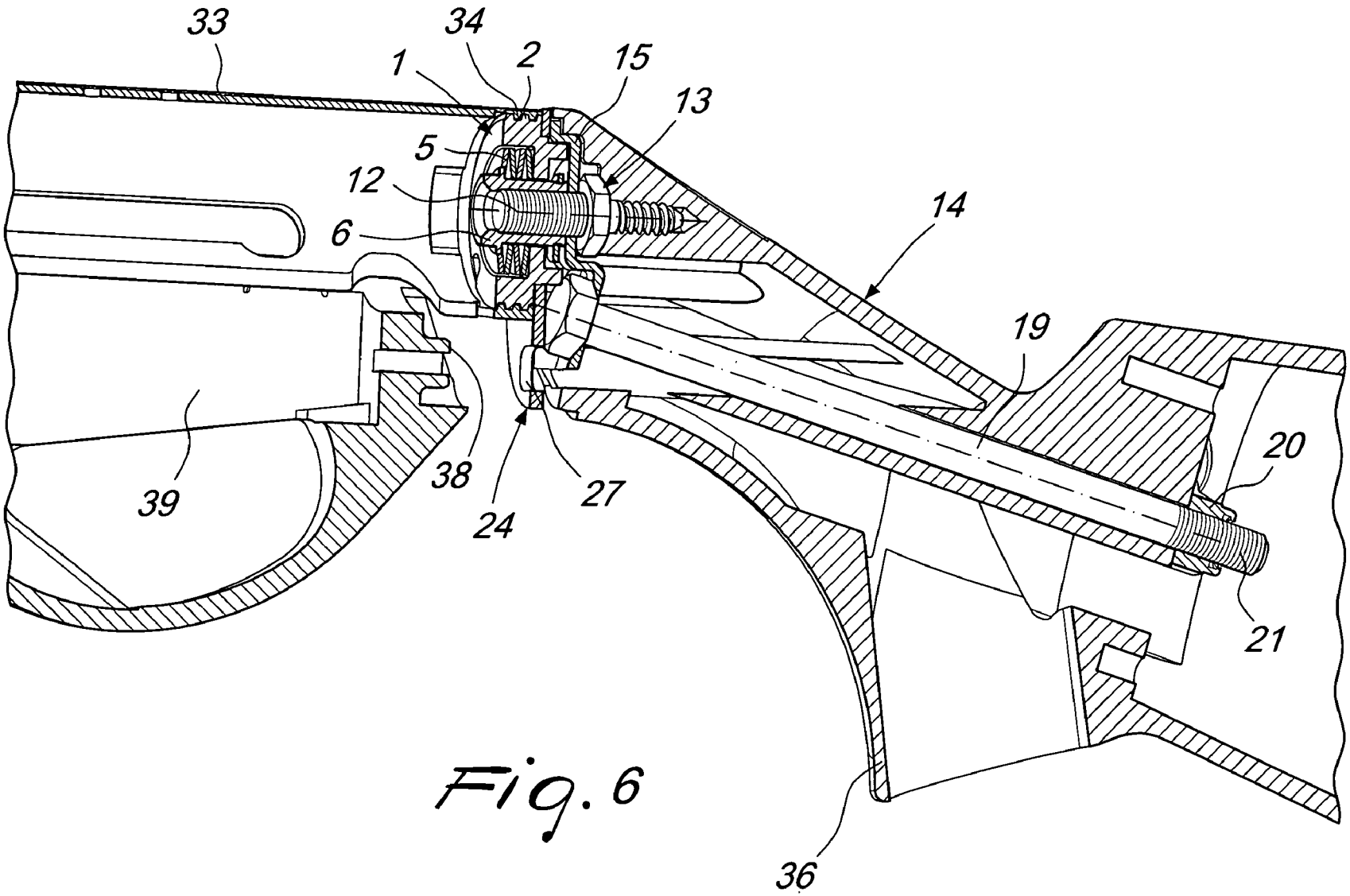
FIG. 6 is a sectional perspective view of the quick coupling according to the present invention, as fitted to the stock of the weapon in the quick coupling position, screwed onto its seat provided on the sheath or barrel extension and the receiver or guard, shown in the pre-assembly step.

The entire stock, 14 complete with the quick coupling, is fitted correctly onto the weapon, as shown in FIG. 6, when, once rotation is completed, the pistol grip of the stock 36 is aligned with the vertical axis of the weapon.

In this position, the plate 24 adheres to the sheath or barrel extension 33 stably, since the screwing of the threaded sectors 2 of the main body 1 with the threaded sectors 34 of the sheath or barrel extension 33 produces a further compression of the Belleville springs 5 which substantially keeps the stock 14 joined to the sheath or barrel extension 33 itself, eliminating any coupling plays due to the machining tolerances of the various components.

In this manner, therefore, the drop and cast given to the plate 24 is transferred to the stock 14 of the weapon and the stock is fitted with a given drop value and a given cast value with respect to the aiming line of the weapon.

In the assembly position described above, the Belleville springs 5 have not yet reached their point of maximum compression, and therefore upon firing the kinetic energy of the recoil of the weapon can further compress the Belleville springs 5 without significantly affecting the drop and cast of the stock, simply dissipating partially before being discharged against the shoulder of the shooter.

To prevent the stock 14 from unscrewing unintentionally and losing its correct position for assembly on the weapon, the plate 24 is provided with the slot 27, on which the rear end 38 of the guard or receiver 39 of the weapon can be registered.

Figure 7:
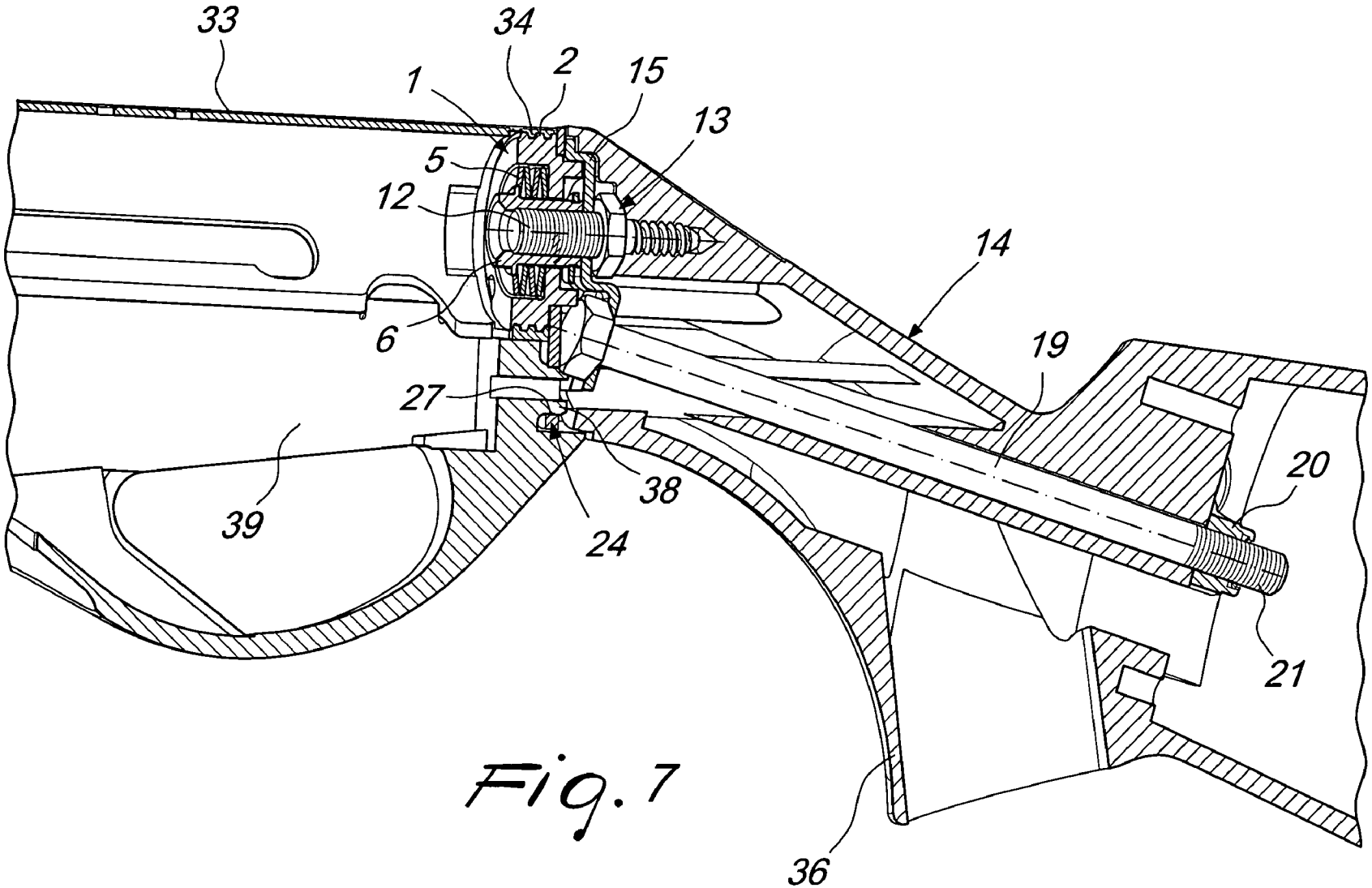
FIG. 7 is a sectional perspective view of the quick coupling as fitted to the stock of the weapon, in the quick coupling position, screwed onto its seat provided on the sheath or barrel extension and with the receiver or guard completely assembled.

FIG. 7 shows the entire system completely assembled, with the rear end 38 of the guard or receiver 39 completely inserted on the slot 27 of the plate 24.

In practice it has been found that the invention achieves the intended aim and objects, a quick coupling having been provided for the stock of a portable weapon which has considerable advantages in terms of constructive technical simplicity, in ease of drop and cast adjustment, and in speed of weapon assembly and maintenance.

The quick coupling according to the present invention also allows to determine automatically the drop and cast when the stock is fitted onto the weapon.

Another advantage of the quick coupling according to the present invention is that it can be easily implemented on any portable weapon and the coupling on the weapon can occur both on its sheath or barrel extension and on the receiver or other conventional components for the weapons being considered.

The coupling point can vary according to the requirements, i.e., according to the design and construction characteristics of the portable weapon to which the stock is to be applied.

The interchangeability of the plate allows to have the same stock fitted on the weapon with drops and casts which are variable as a function of the requirements of the user. For this purpose, plates with different drop and cast trims are manufactured and provided to the user. The user can thus have at his disposal one or more plates suitable for his requirements.

Another advantage of the invention is that, when using the weapon, upon firing, the kinetic energy of the recoil of the weapon can further compress the Belleville springs of the coupling, without affecting the drop and cast of the stock, and partially dissipating before being released against the shoulder of the shooter.

This application claims the priority of Italian Patent Application No. MI2007A001472, filed on Jul. 20, 2007, the subject matter of which is incorporated herein by reference.

What is claimed is:

1. A quick coupling particularly for the stock of a portable weapon, comprising an elastically deformable body fitted to the stock of a portable weapon and provided with a means for engaging a component of said portable weapon, said elastically deformable body having a position which is not elastically deformed and a position which is elastically deformed, said elastically deformable body engaging said component of said portable weapon in said elastically deformed position, said quick coupling further comprising an adjustment member determining the drop and cast of said stock with respect to said elastically deformable body and therefore with respect to said component of said portable weapon, said adjustment member being interposed between said elastically deformable body and said stock.

2. The coupling according to claim 1, wherein said engagement means is constituted by a partial thread.

3. The coupling according to claim 1, wherein said elastically deformable body comprises an assembly constituted by a main annular body which is associated with an axial member by elastic members, said axial member being rigidly connected to said stock.

4. The coupling according to claim 1, wherein said elastically deformable body includes at least one spring member.

5. The coupling according to claim 4, wherein said spring member is a conical annular disk or washer.

6. The coupling according to claim 4, wherein said elastically deformable body further includes a first rigid member and a second rigid member, said spring disposed to bias said first rigid member and said second rigid member relative to one another.

7. The coupling according to claim 1, wherein said adjustment member is a plate having a variation in thickness that determines the drop and cast of said stock with respect to said elastically deformable body and therefore with respect to said component of said portable weapon.

8. A quick coupling particularly for the stock of a portable weapon, comprising an elastically deformable body fitted to the stock of a portable weapon and provided with a means for engaging a component of said portable weapon, said elastically deformable body having a position which is not elastically deformed and a position which is elastically deformed, said elastically deformable body engaging said component of said portable weapon in said elastically deformed position, wherein said elastically deformable body includes a main annular body, an axial member rigidly connected to said stock, and at least one elastic member interposed between said axial member and said main annular body to resiliently bias said axial member and said main annular body relative to one another.

9. A quick coupling particularly for the stock of a portable weapon, comprising an elastically deformable body fitted to the stock of a portable weapon and provided with a means for engaging a component of said portable weapon, said elastically deformable body having a position which is not elastically deformed and a position which is elastically deformed, said elastically deformable body engaging said component of said portable weapon in said elastically deformed position, wherein said elastically deformable body includes an annular main body, a cylindrical centering shank rigidly connected to said stock, and at least one spring member disposed to bias said axial member and said annular main body relative to one another, said annular main body including external threaded sectors which form said means for engaging, said annular main body further including an internal cavity accommodating said at least one spring member and said cylindrical centering shank, said at least one spring member being fitted onto said cylindrical centering shank by a nut provided with an external extension and passing internal through said at least one spring member and said annular main body, a split ring being fitted to said external extension.

10. The coupling according to claim 9, wherein said centering shank is hollow and comprises an internal thread which is suitable to engage a threaded pin which is rigidly associated with said stock.

11. The coupling according to claim 10, wherein when said elastically deformable body is assembled, said at least one spring member is not preloaded in order to allow easy screwing of said centering shank on said threaded pin.

12. The coupling according to claim 11, wherein said main body is associated with said stock by means of a centering member which is rigidly coupled to said stock.

13. The coupling according to claim 12, wherein said centering member is constituted by a contoured plate, which is associated with said stock by means of a screw, said contoured plate comprising a circular centering seat which is suitable to accommodate a cylindrical portion of said annular main body, and a seat for accommodating a head of said screw which rigidly couples said centering plate to said stock.

14. The coupling according to claim 13, further comprising an orientation pin which is rigidly coupled to said stock and is suitable to engage a groove in said main body when said main body is applied to said stock, so as to define a single possible position for the assembly of said main body with respect to said contoured plate which is rigidly coupled to said stock.

15. The coupling according to claim 14, wherein an adjustment member determining the drop and cast of said stock with respect to said elastically deformable body and therefore with respect to said component of said portable weapon is interposed between said elastically deformable body and said stock, said adjustment member being constituted by a contoured abutment plate.

16. The coupling according to claim 15, wherein said abutment plate has a thickness which is differentiated and determined in relation to the drop and cast that said stock must have with respect to the aiming line of the weapon.

17. The coupling according to claim 16, wherein said thickness of said abutment plate is changed, both in relation to its vertical axis and in relation to its horizontal axis, both of said vertical and horizontal axes passing through a central hole of said adjustment plate.

18. The coupling according to claim 17, wherein said abutment plate comprises two grooves, each suitable to accommodate said orientation pin which is jointly connected to said stock so that said abutment plate can be fitted in two positions, one tilted over with respect to the other, on said stock, so as to vary, with said abutment plate, the cast that said stock must have with respect to the aiming line of the weapon.

19. The coupling according to claim 9, wherein said at least one spring member is a conical annular disk or washer member.

* * * * *